United States Patent [19]

Jochum et al.

[11] 4,066,198

[45] Jan. 3, 1978

[54] FASTENING ELEMENT SETTING GUN WITH AN EJECTION MEMBER

[75] Inventors: Peter Jochum, Meiningen, Austria; Hans Dieter Seghezzi, Vaduz, Liechtenstein

[73] Assignee: Hilti Aktiengesellschaft, Schaan, Liechtenstein

[21] Appl. No.: 671,152

[22] Filed: Mar. 29, 1976

[30] Foreign Application Priority Data

Apr. 1, 1975 Germany ..... 2514238

[51] Int. Cl.[2] ..... B25C 1/14

[52] U.S. Cl. ..... 227/8; 227/10

[58] Field of Search ..... 227/8, 10, 11

[56] References Cited

U.S. PATENT DOCUMENTS

| | | | |
|---|---|---|---|
| Re. 27,628 | 5/1973 | Newton et al. | 227/10 |
| 3,330,108 | 7/1967 | Kuaule et al. | 227/11 |
| 3,540,141 | 11/1970 | Butler | 227/10 |
| 3,659,768 | 5/1972 | Brunelle | 227/10 |

*Primary Examiner*—Granville Y. Custer, Jr.
*Attorney, Agent, or Firm*—Toren, McGeady and Stanger

[57] ABSTRACT

In an explosive charge driven setting gun having an axially displaceable barrel and using caseless propellant charges for driving fastening elements into a hard receiving material, the firing chamber in the gun is movable between a charge loading position, a firing position and an ejecting position. The firing chamber can be formed in the barrel so that it is movable with the barrel, or it can be positioned in a separate member rotatable about an axis parallel to the axis of the barrel. An ejecting member is associated with the barrel and is displaceable through the firing chamber when it is in the ejecting position for clearing the chamber of any unfired charges or of the residue of fired charges.

12 Claims, 6 Drawing Figures

FASTENING ELEMENT SETTING GUN WITH AN EJECTION MEMBER

SUMMARY OF THE INVENTION

The present invention is directed to an explosive charge driven setting gun for driving fastening elements, such as studs, bolts, nails and the like into a hard target or receiving material, such as concrete, steel and the like, which includes a gun housing, a barrel axially displaceable within the housing and at least one firing chamber which is displaceable between a charge loading position, a firing position and an ejecting position.

In known setting tools, a drum is positioned within the gun housing for rotation about its axis. The drum is arranged to receive charges in the form of cartridges or caseless pellets. Recesses are provided on and open from the circumference of the drum and are shaped to receive the specific, non-circular cross-section of the charges. In the loading positions, the recesses are filled with propellant charges from a magazine. After ignition in a firing position, the recesses are moved into an ejecting position where empty cartridges can fall out of the recesses under the action of gravity. Further, a gun is known where the spent cartridge is first released by a lever. When caseless charges are used, the combustion residues accumulate on the wall of the recess which also serves as the firing chamber. Due to the residue buildup, the propellant charges no longer fit into the recess with resultant damage to the charges and malfunctioning of the setting gun. Accordingly, such a setting gun requires frequent cleaning or clearing of its firing chamber. This clearing action is one reason why the less expensive caseless propellant charges have not been considered economically feasible over encased charges.

Therefore, the primary object of the present invention is to provide a setting gun utilizing caseless propellant charges, which gun is less prone to malfunctioning and affords longer use between maintenance checks. In accordance with the invention, the problem is solved by employing an ejecting member which is displaced through the firing chamber in the ejecting position with the member having essentially the same cross sectional shape as the firing chamber.

With the ejecting member and the firing chamber having essentially the same cross sectional shape, it is ensured that after each ejecting operation, the combustion chamber is completely cleared. With such an operation it is impossible for any portion of the propellant charge to remain in the firing chamber and impede the introduction of a new propellant charge when the chamber is moved into the loading position. By clearing the firing chamber in each ejecting operation, any remaining residues of the charge are removed from the chamber. As a result, residues from the firing of the charges cannot accumulate in the chamber over a course of time. Accordingly, maintenance of the setting gun is greatly simplified. In constructing a compact setting gun, it is expedient to locate the firing chamber or chambers in a sliding member. A magazine for supplying propellant charges into the firing chamber and a firing device can be located within the setting gun housing, while the firing chamber in a sliding member is moved between various positions.

Since the operating sequence of loading, firing and ejecting always remain the same, it is advantageous if the slide containing the firing chamber is a rotatable member. In such a rotatable member multiple firing chambers can be arranged for passage between the loading, firing and ejecting positions, always in the same sequence and always returning to the starting position after a determined number of movements. To assure that after each movement of the rotatable member a separate and simultaneous operation of loading, firing and ejecting takes place, it is preferable to provide at least three firing chambers on the rotatable slide member. To reduce the angular movement of the slide member, it is also possible to use more than three firing chambers.

To simplify setting gun handling and to ensure the firing chamber is cleared during each movement of the slide member, it is expedient if the ejecting member is fixed to the barrel of the gun. With such an arrangement no separate actuating device is required for the ejecting member. It is especially advantageous if the barrel is axially displaceable relative to the gun housing. The relative movement between the barrel and the housing can be used for the advance of the slide member as well as for the actuation of the ejecting member. For safety reasons, it is customary in explosive charge driven setting guns that a pressing action of the gun onto the receiving material must overcome a certain force before the gun can be fired.

In a particularly simple construction of the setting gun, it is advisable to incorporate the firing chamber into the barrel so that the barrel acts as the slide member. With such a construction, no special actuating members are required for the slide member. Further, such an arrangement also avoids any problems with providing a seal between the firing chamber and the barrel.

For a setting gun with compact outer dimensions, it is advantageous to locate the combustion chamber on the lateral outer surface of the barrel. As s result, the ejecting member can advantageously be displaced perpendicularly to the barrel axis.

For effective safe operation, the setting gun should included a minimum number of movable parts. Therefore, a stationary control cam is preferred for the actuation of the ejecting member. By actuating the ejecting member as the barrel moves axially relative to the housing by means of the control cam, no additional movable part is required.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
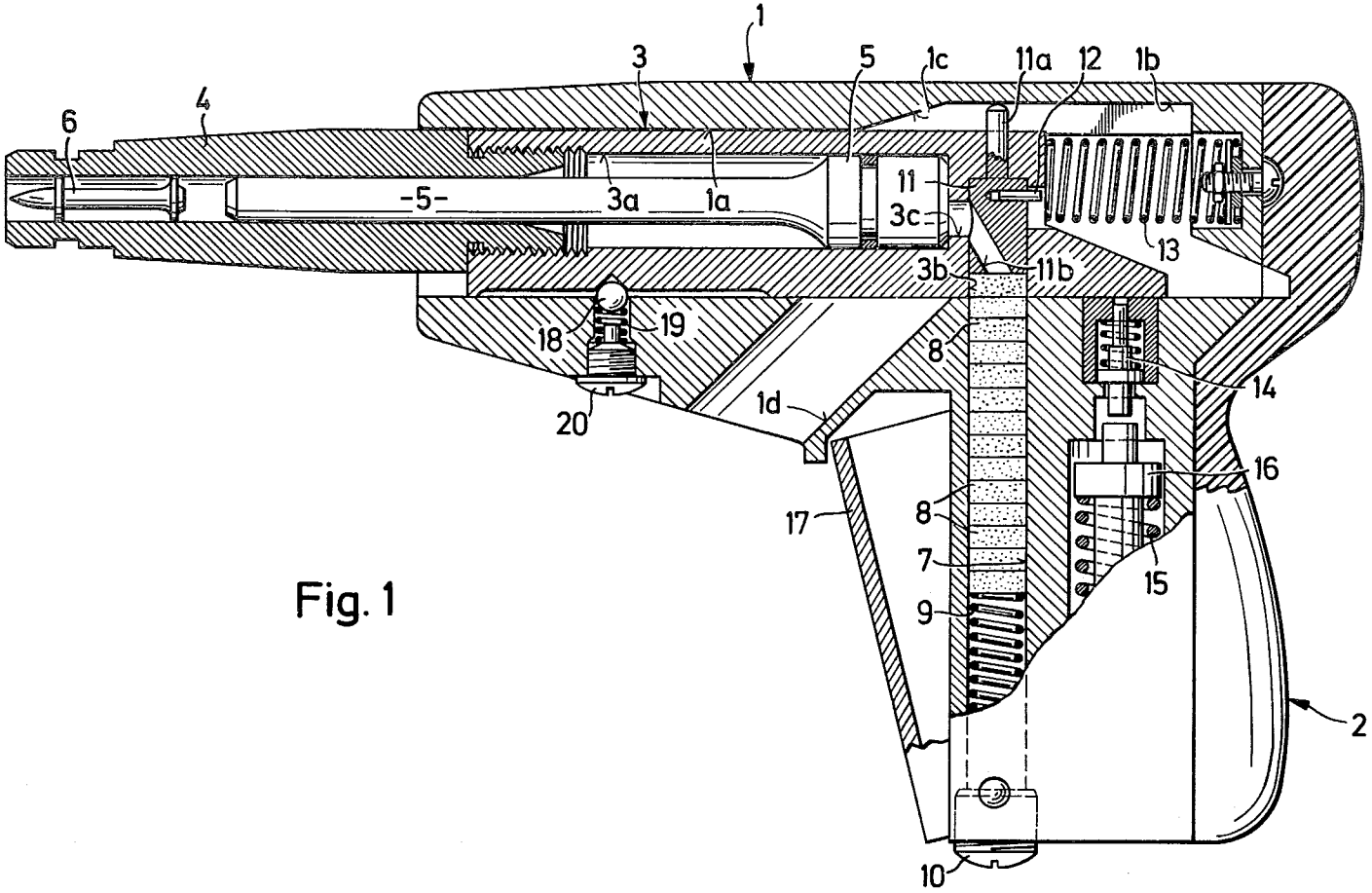
FIG. 1 is a side view, partly in section, of a setting gun embodying the present invention with the gun represented in the loading position.

In FIG. 1, one embodiment of a setting gun incorporating the present invention is illustrated. The setting gun includes a gun housing 1 with a handle 2 attached to and extending laterally from one end of the housing. An axially extending guide bore 1*a* is formed in the housing 1 and a barrel 3 is axially displaceably mounted in the bore. At its front end, the barrel is in threaded engagement with a fastening element guide 4 which is shown projecting outwardly from the gun housing. Within the barrel 3 is a piston guide bore 3*a* in which a driving piston 5 is slidably positioned for axial displacement. At its forward end, the piston extends into the guide 4 and a fastening element or stud 6 is located in the guide ahead of the piston.

A magazine passage 7 is located within the handle 2 extending transversely of the axial direction of the barrel. Caseless propellant charges 8 are stacked one above the other in the magazine passage 7. A feed spring 9 is positioned in the lower end of the passage and biases the charges upwardly toward the lower surface of the barrel 3. At its lower end, the magazine passage 7 is closed by a plug 10.

At the rear end of the barrel a passageway or bore 3*b* is provided extending perpendicularly to the axis of the barrel. An ejecting member 11 in the form of a ram, is axially displaceably mounted in the passageway 3*d*. The ejecting member 11 is secured against rotation by a pin 12. At its upper end, the ejecting member has a smaller diameter pin-shaped projection 11*a* which extends through a correspondingly smaller bore in the upper side of the barrel from which it extends into a longitudinal groove 1*b* in the housing, with the groove extending in the axial direction of the barrel. With the barrel positioned as shown in FIG. 1, the feed spring 9 within the magazine passage 7 pushes the uppermost one of the propellant charges 8 into the lower end of the passageway 3*b* against the ejecting member which is moved upwardly against a shoulder at the upper end of the passageway so that the opening in the lower end of the passageway is just sufficient to receive one propellant charge. Within the housing, rearwardly of the barrel, is a spring 13 which bears at its forward end against the barrel and at its rearward end against the housing.

Within the handle 2 is a firing device which consists of an axially displaceable firing pin 14 extending perpendicularly of the axis of the barrel with a firing spring 15 which provides an upward biasing action for the firing hammer 16. By pressing the trigger 17, the hammer 16 is released and is driven upwardly against the firing pin by the spring. A ball detention device mounted in the housing below the barrel secures the barrel in the charge loading position shown in FIG. 1. The ball detention device consists of a ball 18 biased upwardly by a spring 19 held within a bore in the housing by a locking screw 20. The ball 18 fits within a notch in the lower end of the barrel and an axially extending groove through which the ball is displaceable is located forwardly and rearwardly of the notch.

Figure 2:
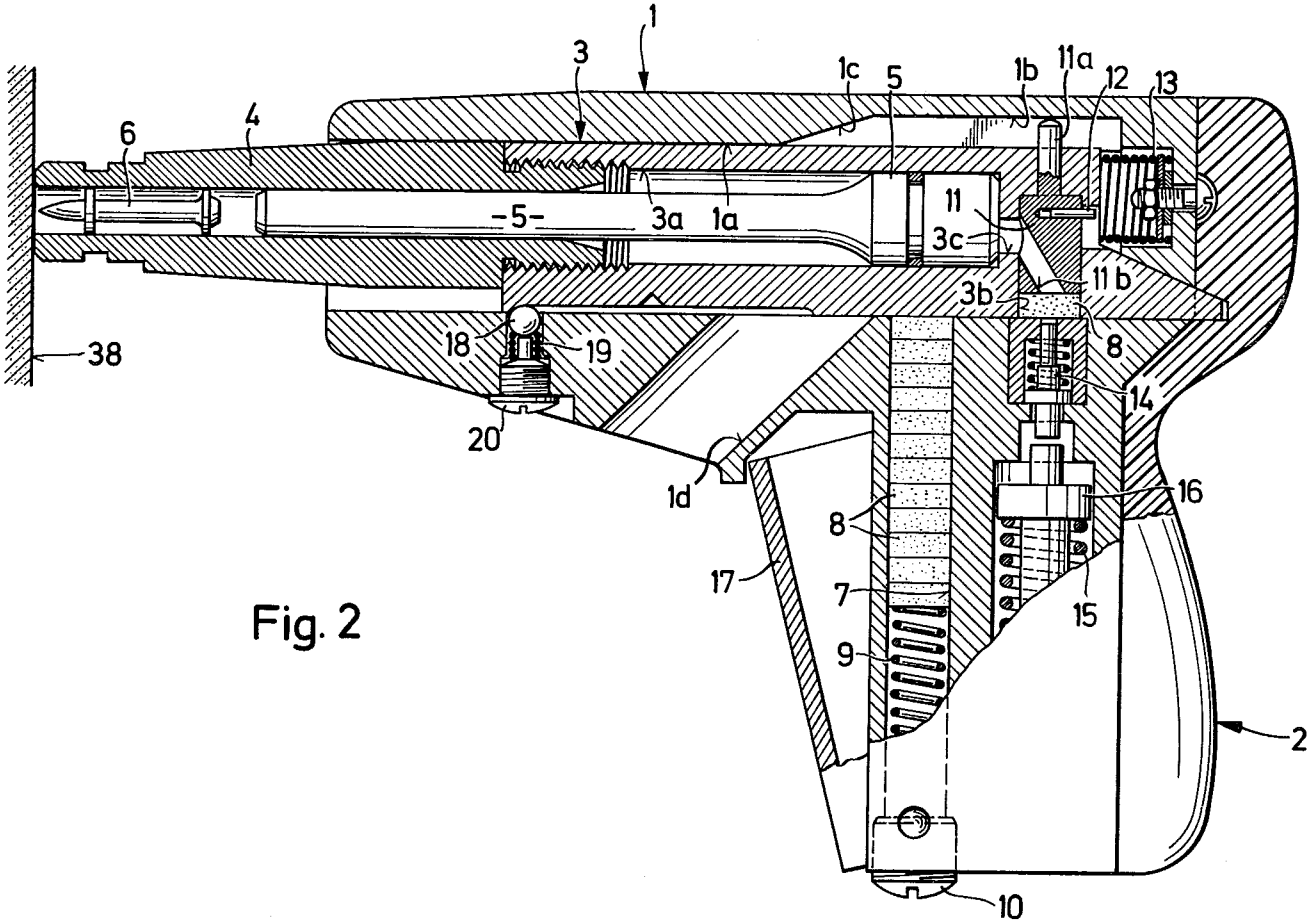
FIG. 2 is a view similar to FIG. 1, however, with the gun shown in the firing position.

In FIG. 2, the barrel has been displaced rearwardly from the loading position shown in FIG. 1 into the firing position, and it can be noted that the ball 18 is positioned at the forward end of the groove in the lower side of the barrel. The loading position is reached by pressing the front end of the gun against the receiving material 38, that is, by pressing the forward end of the fastening element guide 4, which pressing action moves the guide and the barrel 3 rearwardly relative to the housing 1. To effect the rearward movement of the setting gun, the force of the spring 13 must be overcome. As the barrel is displaced rearwardly, the lower end of the passageway 3*b* containing a caseless propellant charge 8 moves over and is aligned with the firing device with the firing pin 14 ready to be driven against the charge. When the firing device is actuated and the charge ignited, propellant gases are generated which flow upwardly through an obliquely arranged passageway 11*b* through the ejecting member 11 into an opening 3*c* into the rear end of the bore 3*a* within the barrel so that the gases acting against the rear end face of the piston 5 can drive it forwardly through the bore with its forward end sliding through the guide 4 for driving the fastening element 6 into the receiving material 38.

Figure 3:
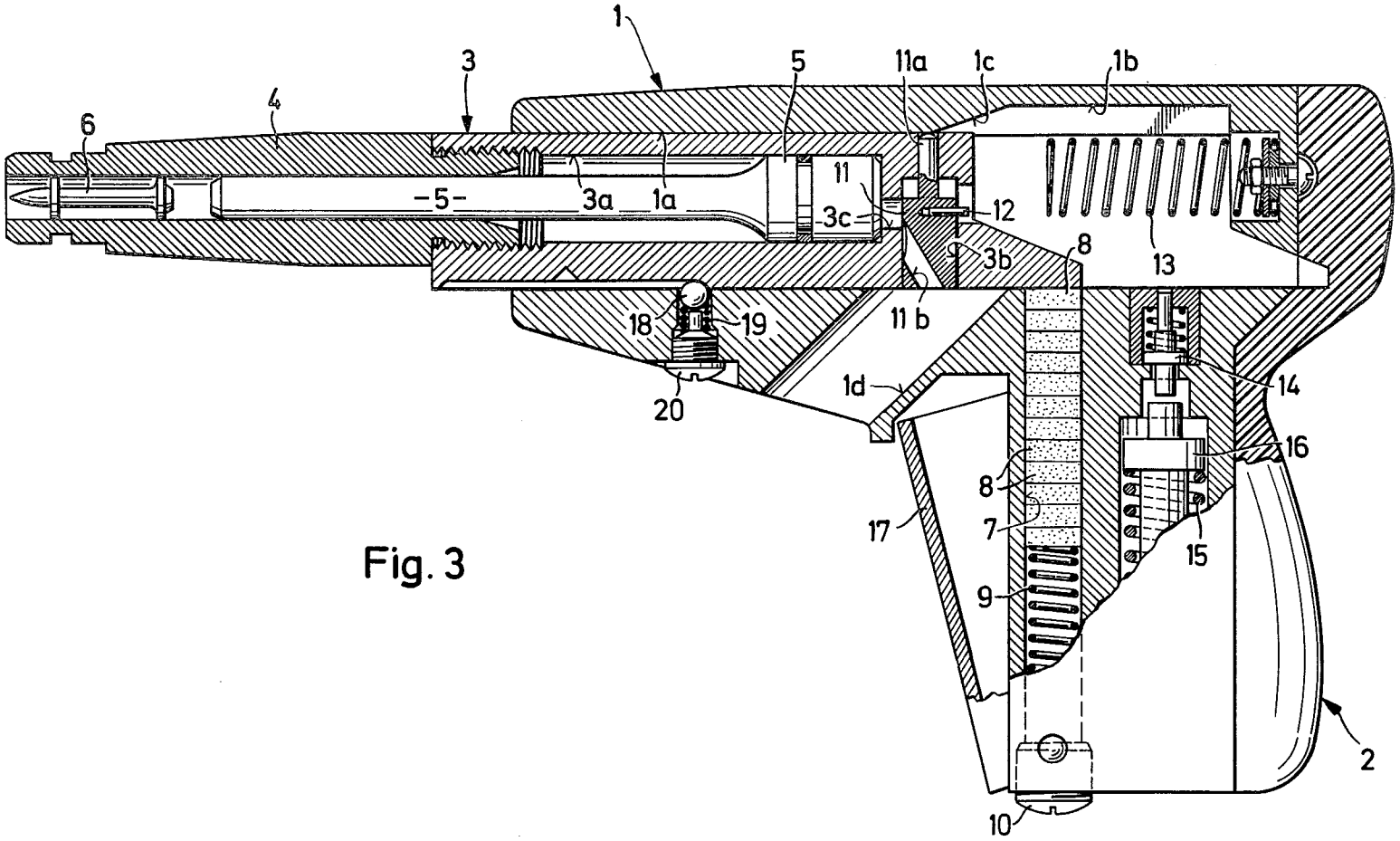
FIG. 3 is a view similar to FIGS. 1 and 2, however, with the gun illustrated in the ejecting position.

In FIG. 3 the setting gun is shown in the ejecting position with the barrel extending forwardly from the housing 1. As can be noted in FIG. 3, the ball 18 is located at the rearward end of the groove in the underside of the barrel limiting the forward movement of the barrel relative to the housing. This forward movement of the barrel relative to the housing effects two functions. First, the piston 5 is moved rearwardly through the barrel to the starting position, note FIG. 1. Second, due to the arrangement of the longitudinal groove 1*b* in the housing, which terminates in a control cam surface 1*c* converging inwardly toward the barrel, the ejecting member 11 is displaced downwardly through the passageway 3*b*. As can be seen in FIGS. 1 and 2, the projection 11*a* rides along the surface of the longitudinal groove 1*b* which is parallel with the axis of the barrel. However, as the barrel moves forwardly relative to the housing, the projection 11*a* comes in contact with the cam surface 1*c* causing the projection and the attached ejecting member to move downwardly through the barrel transversely of its axis. Due to the downward movement of the ejecting member 11 through the passageway 3*b* any residue of an incompletely burnt propellant charge is ejected from the lower end of the passageway which forms the firing chamber, with the residue exiting through the ejection aperture 1*d* formed in the lower side of the housing below the barrel.

Figure 4:
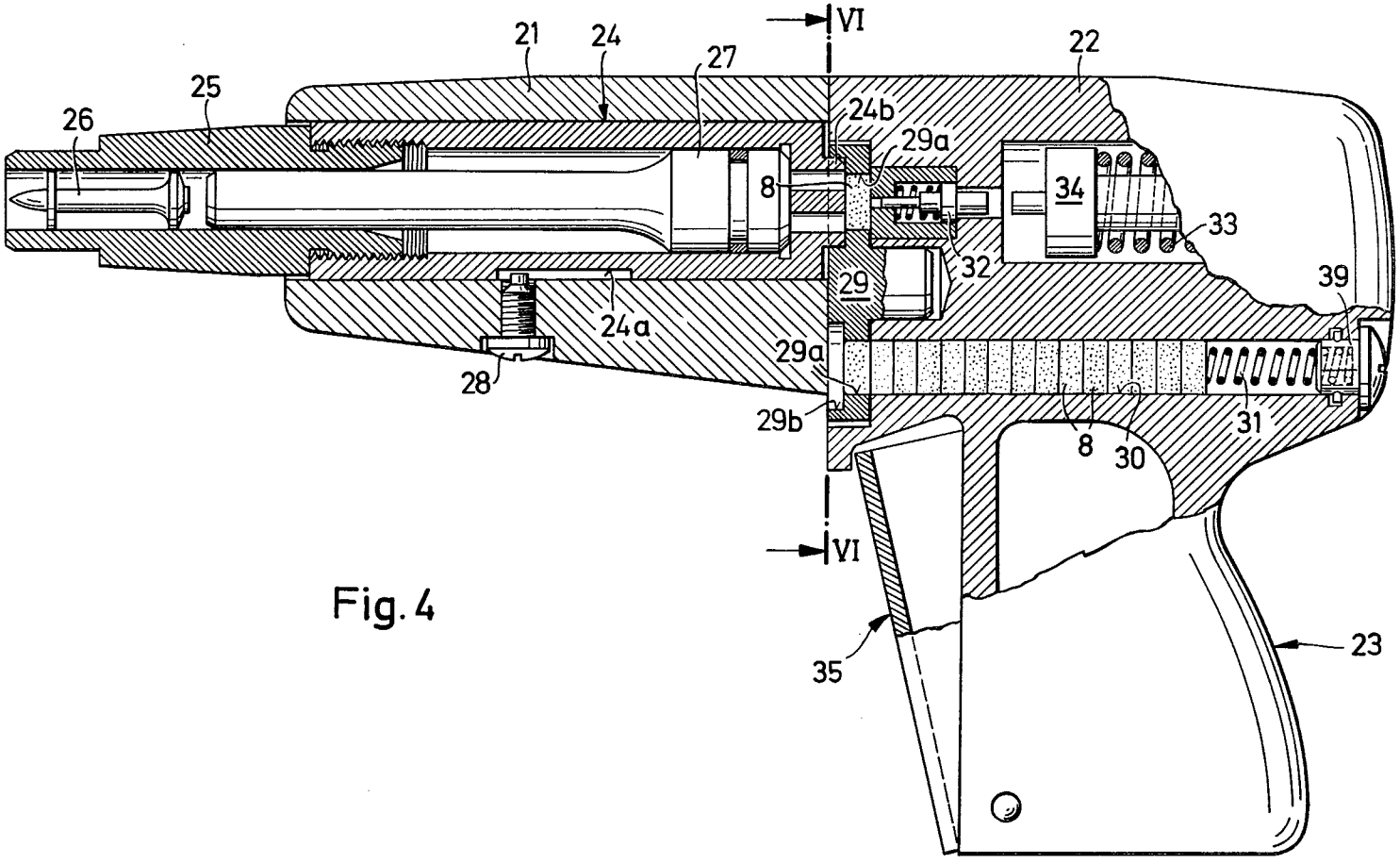
FIG. 4 is a side view, partly in section, of another setting gun embodying the present invention, with the gun in the ready to be fired position and illustrating the section along the line IV—IV in FIG. 6.
Figure 5:
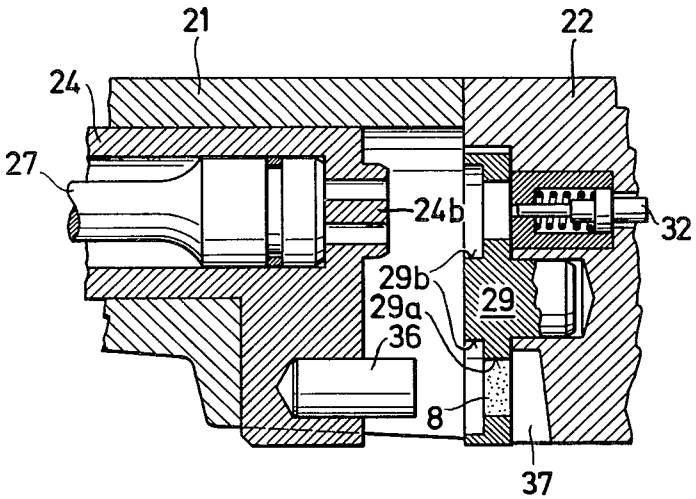
FIG. 5 is a partial sectional view of the setting gun shown in FIG. 4 however, the barrel of the gun is not pressed rearwardly and the section illustrated is taken along the line V—V of FIG. 6.
Figure 6:
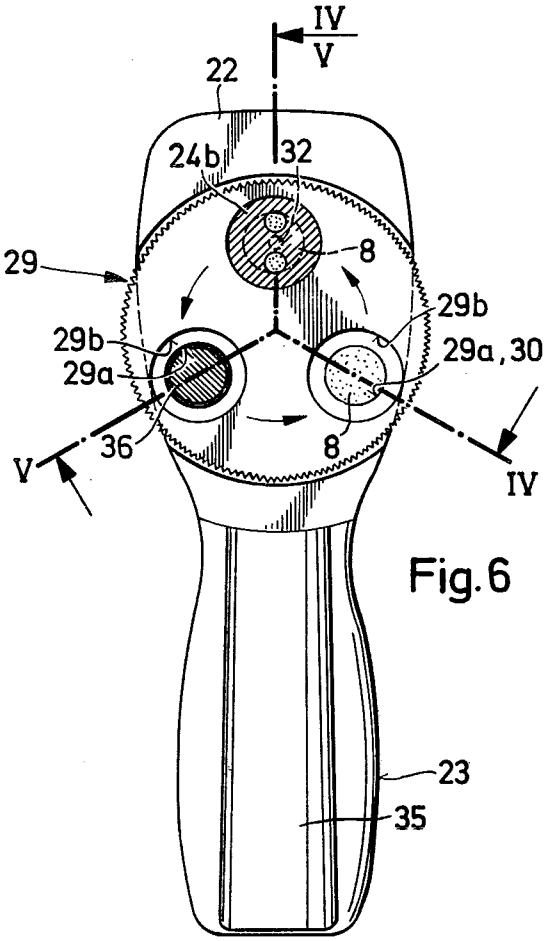
FIG. 6 is a sectional view taken along the line VI—VI of FIG. 4.

In FIGS. 4–6, another embodiment of a setting tool incorporating the present invention is illustrated and, in FIG. 4, the gun is shown in position ready to be fired. The gun includes a front housing part 21 and a rear housing part 22 with a handle 23 extending laterally outwardly from the rear housing part. Axially displaceably mounted in the front housing part 21 is a barrel 24. Threaded onto the front end of the barrel 24 is a fastening element guide 25 in which a fastening element 26 is shown positioned for insertion into the receiving material. Axially displacealy mounted for movement through the barrel 24 and the guide 25 is a driving piston 27. The rear enlarged head-end of the piston rides in the barrel and its forward reduced diameter shank portion rides within the guide. Forward movement of the piston displaces the fastening element 26 outwardly from the guide 25. A stop screw 28 is threaded through the lower side of the housing into a groove 24*a* in the barrel and the screw extending into the groove prevents rotation of the barrel.

Rotatably mounted in the front end of the rear housing part 22 is a rotatable member 29. The rotatable member has three angularly spaced cutouts or openings 29*a* for receiving caseless propellant charges 8. On the forward face of the rotatable member, countersunk recesses 29*b* are centered with respect to the openings 29*a*. As can be seen in FIG. 4, these countersunk recesses are arranged to receive a cylindrical shoulder 24*b* formed on the rearward end of the barrel. In other words, the shoulder or cylindrical projection 24*b* extends into the recess 29*b*. A magazine channel is formed in the rear housing part 22 disposed parallel to and spaced outwardly from the firing axis of the setting gun, that is, the axis of the barrel. The rearward end of the magazine channel 30 is closed by a bayonet bolt 39. Extending forwardly from the bayonet bolt 39 into the channel is a spring 31 which biases a stack of caseless propellant charges 8 toward the forward end of the channel. The spring pushes individual propellant charges 8 outwardly from the mouth of the channel into the opening 29*a* aligned with the channel. Within the rear housing part 22, above the magazine channel 30, is a firing device. The firing device consists of a firing pin 32, a spring 33, and a firing hammer 34. The actuation of the firing device is effected by a trigger 35. The operation of such a firing device is well known, accordingly, further description is not required.

In FIG. 5 a partial section of the setting gun, as shown in FIG. 4, is illustrated with the barrel displaced forwardly of the front face of the rotatable member 29. In this position, the rotatable member 29 is released for rotation about its axis in the direction of the curved arrows shown on the surface of the rotatable member in FIG. 6. As the rotatable member is manually displaced in the direction of the arrows, an empty opening 29*a* presents itself at the outlet from the magazine channel and a previously loaded charge is moved in front of the firing device. Occasionally, the caseless propellant charge cannot be ignited. Accordingly, the unfired charge must be ejected from the opening 29*a* before the opening again presents itself in alignment with the magazine channel 30. Therefore, secured to and extending rearwardly from the rear end of the barrel is an ejecting member 36. As viewed in FIG. 6, the ejecting member 36 is offset laterally from a vertical line extending through the center of the rotatable member 29 which bisects the opening 29*a* located in the firing position aligned with the firing pin 32, note FIG. 4. As the barrel is pressed rearwardly within the housing, the ejector member 36 passes through the aligned opening 29*a* in the slide member and ejects any propellant charge into an ejection slot 37 rearwardly of the slide member so that the charge falls out of the housing. The transverse cross sectional shape of the ejecting member corresponds approximately to the transverse cross sectional shape of the opening 29*a* so that any residue of a fired charge remaining in the opening is displaced by the ejecting member. To prevent individual propellant charges from being displaced forwardly from the magazine channel through an opening 29*a*, the opening is slightly tapered inwardly toward the barrel which prevents such displacement. However, the extent of the taper is very small and the clearing or cleaning effect of the ejecting member is not impaired.

While specific embodiments of the invention have been shown and described in detail to illustrate the application of the inventive principles, it will be understood that the invention may be embodied otherwise without departing from such principles.

What is claimed is:

1. Explosive charge driven setting gun for driving fastening elements into hard receiving materials such as steel, concrete and the like, comprising a gun housing, magazine means for feeding caseless propellant charges within said housing, means movably displaceable within said housing including at least one firing chamber with said firing chamber being movable between spaced positions including a loading position for receiving a caseless charge from said magazine means, a firing position for igniting the charge within said firing chamber and an ejecting position for clearing said firing chamber, wherein the improvement comprises that said movably displaceable means includes an ejecting member positioned adjacent the location of said firing chamber in the ejecting position and arranged to be moved through said firing chamber for clearing the chamber, and said ejecting member having a cross sectional shape transverse to its direction of movement through said firing chamber which is substantially the same as the cross sectional shape of said firing chamber in the same transverse direction.

2. Explosive charge driven setting gun, as set forth in claim 1, wherein said movably displaceable means comprises a barrel having an axially extending bore, said barrel displaceable in the axial direction of its bore, and said firing chamber comprising an opening formed in the lateral surface of said barrel outwardly from the bore therein.

3. Explosive charge driven setting gun, as set forth in claim 2, wherein said ejecting member is positioned in said barrel and is movably displaceable through said firing chamber formed in said barrel.

4. Explosive charge driven setting gun, as set forth in claim 3, wherein the bore in said barrel has a forward end and a rearward end with the fastening elements being driven outwardly from the forward end, a passageway extending through said barrel adjacent the rearward end of said bore with the passageway disposed approximately perpendicularly to the axis of said bore, said passageway having a smaller diameter on one side of said barrel and a larger diameter on the opposite side of said barrel, the end of said passageway having the larger diameter forming said firing chamber, said ejecting member displaceably mounted within said passageway and having a transverse cross sectional shape similar to the transverse cross sectional shape of said passageway, a pin-shaped projection of smaller diameter than said ejecting member secured to and extending from said ejecting member through the smaller diameter end of said passageway.

5. Explosive charge driven setting gun, as set forth in claim 4, wherein said housing has a groove formed therein facing toward said barrel and said groove being elongated in the axial direction of said barrel, said groove having a cam surface therein converging inwardly toward said barrel, said cam surface being disposed in the range of movement of said rear end of said barrel containing said passageway within which said ejecting member is positioned, said pin-shaped projection on said ejecting member arrranged to extend outwardly from the smaller diameter end of the passageway in said barrel into said groove and said pin-shaped projection arranged to contact said cam surface when said barrel is moved forwardly through said housing for displacing said ejecting member through said passageway for clearing any portion of a propellant charge remaining in the firing chamber.

6. Explosive charge driven setting gun, as set forth in claim 5, wherein said housing includes an ejecting passageway arranged to align with said firing chamber when said ejecting member is displaced through said firing chamber by the interaction of said pin-shaped projection and said cam surface.

7. Explosive charge driven setting gun, as set forth in claim 6, wherein said ejecting member has a passageway extending therethrough for connecting said firing chamber to the bore in said barrel.

8. Explosive charge driven setting gun, as set forth in claim 1, wherein said movably displaceable means comprises a barrel having an axially extending bore therein, and a member rotatably mounted in said gun housing about an axis disposed in substantially parallel relation with the axis of the bore in said barrel said firing chamber being formed in said member.

9. Explosive charge driven setting gun, as set forth in claim 3, wherein said ejecting member is attached to said barrel and is movably displaceable with said barrel for movement through said firing chamber.

10. Explosive charge driven setting gun, as set forth in claim 9, wherein said rotatable member comprises at least three angularly spaced openings therethrough each arranged to form a firing chamber, said rotatable member having a first face directed toward said barrel and a second face directed in the opposite direction from said barrel, each of said openings through said rotatable member having a countersunk portion on the surface facing toward said barrel, the end of said barrel having a cylindrically shaped projection arranged to fit into the countersunk portion of said openings when the openings are located in alignment with said barrel.

11. Explosive charge driven setting gun, as set forth in claim 10, wherein said barrel is axially displaceable within said housing for an extent so that said ejecting member is displaced forwardly from the surface of said rotatable member facing toward the barrel so that said rotatable member can be rotated within said housing for moving said openings therein between the loading position, the firing position and the ejecting position without interference from said ejecting member.

12. Explosive charge driven setting gun, as set forth in claim 11, wherein said openings in said rotatable member inwardly from the countersunk portion are tapered slightly inwardly from the surface facing in the opposite direction from the barrel toward the surface facing toward the barrel for preventing charges from being displaced through the openings.

* * * * *